US012642314B2

(12) United States Patent
Marschall

(10) Patent No.: US 12,642,314 B2
(45) Date of Patent: Jun. 2, 2026

(54) ENERGY ABSORBING SYSTEM

(71) Applicant: RE-ZRO Limited, London (GB)

(72) Inventor: Wilhelm Marschall, London (GB)

(73) Assignee: RE-ZRO Limited, London (GB)

( * ) Notice: Subject to any disclaimer, the term of this patent is extended or adjusted under 35 U.S.C. 154(b) by 0 days.

(21) Appl. No.: 18/835,415

(22) PCT Filed: Nov. 16, 2022

(86) PCT No.: PCT/GB2022/052908
§ 371 (c)(1),
(2) Date: Aug. 2, 2024

(87) PCT Pub. No.: WO2023/148465
PCT Pub. Date: Aug. 10, 2023

(65) Prior Publication Data

US 2025/0134186 A1 May 1, 2025

(30) Foreign Application Priority Data

Feb. 3, 2022 (GB) ..... 2201420

(51) Int. Cl.
*A41D 13/015* (2006.01)
*A41D 13/05* (2006.01)

(52) U.S. Cl.
CPC ..... *A41D 13/015* (2013.01); *A41D 13/05* (2013.01); *A41D 2600/102* (2013.01)

(58) Field of Classification Search
CPC .... A41D 13/015; A41D 13/05; A41D 13/065; A41D 13/08; A42B 3/06
See application file for complete search history.

(56) References Cited

U.S. PATENT DOCUMENTS 4,194,255 A 3/1980 Poppe
4,558,470 A * 12/1985 Mitchell ..... A42B 3/124 2/908

(Continued)

FOREIGN PATENT DOCUMENTS

CA 3157673 A1 * 5/2021 ..... B60N 2/4242
EP 2399470 A1 * 12/2011 ..... A41D 13/05

(Continued)

OTHER PUBLICATIONS

Combined Search and Examination Report for Appln. No. GB 2201420.3 dated Jul. 13, 2022 , pp. 1-8.

(Continued)

*Primary Examiner* — Tajash D Patel
(74) *Attorney, Agent, or Firm* — Lerner David LLP

(57) ABSTRACT

Apparatus (100) for absorbing an impact is disclosed. The apparatus (100) comprises a connected array of tubular structures (101) defining a surface. Each tubular structure (101) has a wall (103) defining an interior region (104) of the tubular structure (101) extending substantially along an axial direction of said tubular structure (101). The axial direction of each tubular structure (101) extends substantially perpendicularly to the surface. The wall (103) of each of a plurality of the tubular structures (101) is at least partially discontinuous, such that said tubular structures (101) preferentially deform in the region of the discontinuity during an impact.

20 Claims, 10 Drawing Sheets

(56) References Cited

U.S. PATENT DOCUMENTS

| | | | | |
|---|---|---|---|---|
| 4,766,614 | A * | 8/1988 | Cantwell | A42B 3/281 2/419 |
| 5,007,111 | A * | 4/1991 | Adams | A41D 13/0155 2/22 |
| 6,079,056 | A * | 6/2000 | Fogelberg | A41D 13/0153 2/92 |
| 7,673,351 | B2 * | 3/2010 | Copeland | A41D 31/285 2/425 |
| 9,320,311 | B2 * | 4/2016 | Szalkowski | A42B 3/12 |
| 9,474,313 | B2 * | 10/2016 | Kamradt | F16F 3/093 |
| 10,099,107 | B2 * | 10/2018 | Liang | A41D 3/06 |
| D927,084 | S * | 8/2021 | Bologna | D29/122 |
| 12,102,159 | B2 * | 10/2024 | Stone | A42B 3/065 |
| 2006/0070170 | A1 | 4/2006 | Copeland et al. | |
| 2006/0070171 | A1 | 4/2006 | Copeland et al. | |
| 2013/0234376 | A1 * | 9/2013 | Frey | A41D 13/015 267/141 |
| 2014/0325745 | A1 * | 11/2014 | Erb | A63B 71/10 2/414 |
| 2016/0347027 | A1 | 12/2016 | Chen et al. | |
| 2017/0303622 | A1 | 10/2017 | Stone et al. | |
| 2018/0055102 | A1 | 3/2018 | Desnoyers | |
| 2019/0191794 | A1 * | 6/2019 | Boria | A41D 13/0531 |
| 2022/0192307 | A1 * | 6/2022 | Light | A42B 3/06 |
| 2022/0232924 | A1 * | 7/2022 | Cook | A42B 3/32 |
| 2023/0010873 | A1 * | 1/2023 | Storey | A42B 3/124 |

FOREIGN PATENT DOCUMENTS

| | | | | |
|---|---|---|---|---|
| GB | 2467646 | A * | 8/2010 | A41D 13/06 |
| JP | 2007254920 | A | 10/2007 | |
| WO | 2018128646 | A1 | 7/2018 | |

OTHER PUBLICATIONS

International Search Report including Written Opinion for Application No. PCT/GB2022/052908 dated Jan. 31, 2023, pp. 1-12.

* cited by examiner

ENERGY ABSORBING SYSTEM

CROSS REFERENCE TO RELATED APPLICATIONS

The present application is a national phase entry under 35 U.S.C. § 371 of International Application No. PCT/GB2022/052908, filed Nov. 16, 2022, which claims priority from GB Application No. 2201420.3, filed Feb. 3, 2022, the disclosures all of which are incorporated herein by reference.

FIELD OF THE INVENTION

The present invention relates to an apparatus for absorbing an impact and a method of manufacturing said apparatus.

BACKGROUND TO THE INVENTION

Protective garments are commonly worn during activities in which an impact is likely. For example, while riding a motorcycle, motorcyclists commonly wear limb protectors and back protectors. These protectors need to be rigid enough to protect the user from abrasion and object penetration and also spread the effect of the impact over a larger area, but must also be soft enough to deform under impact and reduce deceleration of the wearer or object during an impact. The protectors also need to be flexible in order for the user to move freely and comfortably.

The performance requirements for motorcyclists' limb joint impact protectors and motorcyclists' back protectors are set out in the EN 1621-1 2012 and EN 1621-2 2014 standards. These provide maximum transmitted force and performance levels which must be achieved following prescribed tests in order to pass the standard.

In order to provide a flexible protective garment, a relatively soft foam material can be used such as polyurethane foam. However, the foam needs to be relatively thick in order to pass the standards, which adds weight and visual bulk for the user.

It is desirable to provide a protector that is lighter, more flexible and more breathable than existing protectors, whilst meeting the standards.

SUMMARY OF THE INVENTION

An aspect of the invention provides an apparatus for absorbing an impact. The apparatus comprises: a connected array of tubular structures defining a surface for absorbing an impact, each tubular structure having a wall defining an interior region of the tubular structure extending substantially along an axial direction of said tubular structure; wherein the axial direction of each tubular structure extends substantially perpendicularly to the surface. The wall of each of a plurality of the tubular structures is at least partially discontinuous, such that said tubular structures preferentially deform in the region of the discontinuity during an impact.

Advantageously, the at least partial discontinuity controls and facilitates compression and deformation of the tubular structures in the apparatus during an impact. An at least partial discontinuity acts like a crumple zone to absorb an impact, preferentially deforming and collapsing the tubular structure in the region of the discontinuity when force is applied along the axial direction or at an acute angle to the axial direction. This allows a harder material to be used for the apparatus, which may therefore be thinner, lighter and more breathable whilst still having the required impact performance.

It will be appreciated that the surface defined by the connected array of tubular structures will not typically be a continuous flat surface, instead often having openings or a honeycomb-like structure owing to the specified arrangement of the tubular structures.

It should also be noted that only a plurality of the tubular structures may be at least partially discontinuous. It will typically be preferred that substantially all of the tubular structures in the array of tubular structures are at least partially discontinuous, but there may be cases in which it is desirable to incorporate some tubular structures without a partial discontinuity, either in a particular region of the apparatus, or interspersed across the array.

Preferably, the wall of each of a plurality of the tubular structures is partially discontinuous, i.e. only partially discontinuous, such that at least a portion of the wall extends completely around the interior region. Therefore the wall of each of the plurality of tubular structures preferably comprises a continuous portion and a discontinuous portion. For example a first portion of the wall may be continuous, i.e. the first portion of the wall may extend completely around a corresponding portion of the interior region, and a second portion of the wall may be discontinuous, i.e. there may be a discontinuity, or gap, in the second portion of the wall, such that the wall does not completely surround the corresponding portion of the interior region. Preferably, the wall at one end of each tubular structure along the axial direction, preferably the same end and preferably the end not intended to receive an impact (i.e. the side intended to be placed against the body or item being protected) is continuous, such that the wall at said end extends completely around the interior region.

Advantageously a wall which is only partially discontinuous provides improved control of the compression and serves to absorb and dissipate energy during an impact. A wall having only a partial discontinuity beneficially provides additional control in comparison with a wall having no continuous portion. The partial discontinuity limits the deformation and compression of the tubular structure which advantageously improves performance.

While it is preferred for the tubular structures to be only partially discontinuous, it is also possible for the wall of each of a plurality of the tubular structures to be entirely discontinuous, i.e. there may be a discontinuity, or gap, in the wall such that the two ends of the wall do not meet and no portion of the wall entirely surrounds the interior region. Fully discontinuous walls of the tubular structures were found to result in a more flexible structure than a continuous or partially discontinuous wall, but suffered from more lateral movement during impacts.

Preferably, the at least partial discontinuity is provided in the wall of the respective tubular structure along no more than 25% of the length of the wall in the plane perpendicular to the axial direction. That is, the partial discontinuity should only affect a small overall proportion of the wall of the tubular structure along its length in the plane perpendicular to the axial direction, since the partial discontinuity weakens the wall. The at least partial discontinuity is intended to weaken small parts of the wall of the tubular structure in order to control deformation, but the bulk of the wall of each tubular structure should remain in order to provide sufficient resistance to any impact.

It will be noted that the present disclosure often refers to a plurality of the tubular structures. Except where otherwise specified, this may preferably be the same plurality of tubular structures which are defined above as being at least partially discontinuous, but may alternatively be a different plurality of tubular structures. Pluralities that are different may have no overlap, some overlap, or may entirely overlap. For example, the plurality of tubular structures which are only partially discontinuous may be the same plurality of tubular structures which are at least partially discontinuous, or may be only a subset thereof, i.e. with other tubular structures being fully discontinuous.

Optionally the wall of one or more, preferably each, of the tubular structures is tapered along the respective axial direction. Advantageously, this can simplify the manufacturing process as tapered walls typically ensure the apparatus is easier to remove following a forming process such as injection moulding. Preferably, the walls of a plurality of the tubular structures, preferably each tubular structure, are tapered in the same direction along the axial direction relative to the surface. Typically the wall of one or more, preferably each, of the tubular structures has a first end and a second end, wherein the first end is smaller than the second end due to the tapered wall, and the first end is discontinuous or the first and second ends are both discontinuous.

As outlined above, the purpose of the discontinuity in the wall of the tubular structures is to provide a region that will preferentially deform during an impact. Any form of discontinuity may be used that weakens an area of the wall of said tubular structures. However, preferably, the wall of each of the plurality of the tubular structures comprises a notch such that the wall is partially discontinuous. A notch or cut-out into one end of the wall along the axial direction of a tubular structure has been found to provide the best results in terms of controlling compression of the tubular structures in the apparatus. Alternatives to a notch may include a perforation of a region of the wall or a thinner region of the wall.

Examples of notches include triangular or rectangular cut-outs in an end of the wall of a tubular structure. Each notch may be any shape and may be the same shape as the notch of another tubular structure in the apparatus or a different shape. Preferably the widest region of the notch is at the end of the wall along the axial direction. Typically the base of the notch may be pointed, curved, or flat and the sides of the notch may be parallel to the axial direction of the tubular structure or tapered towards the base of the notch.

Typically, the notch extends through the full thickness of the wall between the interior region of said tubular structure and an exterior of said tubular structure, which may improve the way the tubular structure deforms under impact. However, alternatively, the notch may extend through a partial thickness of the wall between the interior region of said tubular structure and the exterior of said tubular structure.

Typically, the notch of each of the plurality of the tubular structures is located in the same side of the respective tubular structure along the axial direction relative to the surface. Preferably, the notches are located on the side on which an impact is expected. Advantageously this can help control compression during an impact.

Preferably, the maximum width of the notch along the length of the wall in the plane perpendicular to the axial direction is less than 25% of the length of the wall of said tubular structure in said plane, preferably between 10% and 25% of the length of the wall of said tubular structure in said plane. A notch which is too narrow may not deform preferentially during an impact in the region of the notch; a notch which is too wide may compress too readily during an impact owing to the absence of a large amount of material making up the wall. Therefore the above range of maximum widths relative to the wall length of the tubular structure provides a good balance of the compression and deformation of the tubular structure during an impact. It is possible to provide one or more tubular structures with a plurality of notches, but in this case the total length of the wall in the plane perpendicular to the axial direction having a notch should be less than 25% of the total length of the wall and preferably between 10% and 25% of the total length of the wall.

While it is possible to provide one or more tubular structures with a plurality of notches, it is nonetheless most preferred that a plurality of tubular structures having an at least partial discontinuity have only one notch. This achieves the desired deformation control without overly weakening the wall. In other embodiments, however, a plurality of tubular structures having an at least partial discontinuity may have up to five notches each, preferably up to four notches each, more preferably up to three notches each, even more preferably up to two notches each.

A notch should extend only part way along the tubular structure along the axial direction. Typically, the maximum depth of the notch along the axial direction is between 5% and 75% of the height of the wall of the tubular structure along the axial direction. A shallower notch will cause the tubular structure to deform less upon impact, whereas a deeper notch will cause more deformation upon impact. This range of depths relative to the wall height of the tubular structure ensures that the compression and deformation of the tubular structure is controlled according to use requirements during an impact. The apparatus can therefore advantageously be made lighter and more breathable by controlling the compression and deformation of the tubular structure in this way. Optionally, the maximum depth of the notch may be between 5% and 25% of the height of the wall of the tubular structure. This may allow a softer material to be used, which may be beneficial for uses that are not likely to experience significant abrasion or objects that may penetrate the apparatus. Alternatively, the maximum depth of the notch may be between 25% and 50% of the height of the wall of the tubular structure. As a further alternative, the maximum depth of the notch may be between 50% and 75% of the height of the wall of the tubular structure. A deeper notch (having a maximum depth between 50% and 75% of the height of the wall of the tubular structure) can be manufactured from a harder material which may provide additional protection against abrasion during an impact.

Preferably, the plurality of tubular structures are connected by a connecting sheet or array of connecting members such that each tubular structure has at least one free end, spaced from the connecting sheet or array of connecting members along the axial direction. Preferably each at least partial discontinuity in the wall of a plurality of the tubular structures is provided in or proximate a free end of the respective tubular structure. Also preferably, the partial discontinuity is not provided in the tubular structure at any one location along the axial direction where the tubular structure is connected to the connecting sheet or array of connecting members or proximate the connecting sheet or array of connecting members. That is, the partial discontinuity should be spaced along the axial direction from the connecting sheet or array of connecting members. For example, preferably each notch of each of the plurality of the tubular structures is located in a free end of the respective tubular structure, e.g. extending from the free end towards (but not reaching) the connecting sheet or array of connecting members. This ensures that the at least partial discontinuity acts to influence the deformation of the free end of the tubular structure, which is prone to greater movement than a connected end of the tubular structure. Indeed, it is typically the free end of the tubular structure that will be arranged to receive an impact. Each tubular structure could have only one free end, which is preferably on the same side in the axial direction of the connecting sheet or array of connecting members, e.g. if the connecting sheet or array of connecting members is connects at a base end of each tubular structure. However, in other embodiments, one or more of the tubular structures could have two free ends, e.g. if the connecting sheet or array of connecting members connects in a central portion of the tubular structures along the axial direction.

Preferably, each of a plurality of the tubular structures is connected to one or more adjacent tubular structures in the array using respective connecting members. This provides a particularly advantageous way of forming a connected array of tubular structures defining a surface, as it reduces weight and increases the flexibility of the apparatus and also allows airflow around the connecting members between the tubular structures for cooling. These features make the apparatus more comfortable for a user to wear. Alternatively, each of a plurality of the tubular structures may be disposed on or in a membrane or connecting sheet to form a connected array of tubular structures defining a surface.

Preferably, the height of each of the said tubular structures along the axial direction is greater than the height of each of its connecting members or the connecting sheet along said direction. Preferably, the connecting members or connecting sheet will be disposed towards the end of the tubular structures away from the side on which an impact is expected. This ensures that the impact is primarily absorbed by the tubular structures and not the connecting members or connecting sheet. Furthermore, a thinner connecting sheet or connecting members will reduce the weight of the apparatus.

Typically, the cross-section of each of a plurality of the tubular structures in a plane perpendicular to the respective axial direction is a polygon. For example, the cross-section may be circular, hexagonal, square or triangular. Preferably the polygon is a regular polygon. The advantage of using polygons, including regular polygons, is that these shapes are easy to manufacture and can readily be used to form a connected array. Preferably, the or each at least partial discontinuity in a tubular structure is located away from any corners of the tubular structure. Where the cross-section of a tubular structure in a plane perpendicular to the respective axial direction is a circle or oval, a partial discontinuity may be provided at any position along the length of the wall in the plane perpendicular to the axial direction. However, where the cross-section is of a shape with corners, then ensuring that the discontinuity is away from those corners has been found to lead to better deformation of the tubular structure during impact.

Typically, the height of the wall of each of the tubular structures along the axial direction is between 2 millimetres and 25 millimetres, preferably between 2 millimetres and 20 millimetres, more preferably between 3 millimetres and 10 millimetres. A thinner structure (i.e. one in which the height of the tubular structures is smaller) will advantageously be more flexible and more lightweight. However, a structure which is too thin will not adequately protect a user against an impact. A thicker structure will advantageously ensure the user is protected, but will be less flexible and heavier. The above ranges balance these considerations to provide an apparatus which is flexible, lightweight, and protects a user during an impact.

When the apparatus is intended for use as a level-1 limb protector, i.e. a limb protector that will pass the EN1621-1 level 1 standard, the height of the wall of each of the tubular structures along the axial direction is more preferably between 5 millimetres and 7.5 millimetres, most preferably between 6 millimetres and 7 millimetres. This size has been found particularly suitable for forming an apparatus that passes the EN 1621-1 level 1 standard whilst being suitably flexible, lightweight and breathable.

When the apparatus is intended for use as a level-2 limb protector, i.e. a limb protector that will pass the EN1621-1 level 2 standard, the height of the wall of each of the tubular structures along the axial direction is more preferably between 7.5 millimetres and 10 millimetres, most preferably between 8 millimetres and 9 millimetres. This size has been found particularly suitable for forming an apparatus that passes the EN 1621-1 level 2 standard whilst being suitably flexible, lightweight and breathable.

When the apparatus is intended for use as a level-1 back protector, i.e. a back protector that will pass the EN1621-2 level 1 standard, the height of the wall of each of the tubular structures along the axial direction is more preferably between 8 millimetres and 10 millimetres, most preferably between 8 millimetres and 9 millimetres. This size has been found particularly suitable for forming an apparatus that passes the EN 1621-2 level 1 standard whilst being suitably flexible, lightweight and breathable.

When the apparatus is intended for use as a level-2 back protector, i.e. a back protector that will pass the EN1621-2 level 2 standard, the height of the wall of each of the tubular structures along the axial direction is more preferably between 10 millimetres and 18 millimetres, most preferably between 15 millimetres and 17 millimetres. This size has been found particularly suitable for forming an apparatus that passes the EN 1621-2 level 2 standard whilst being suitably flexible, lightweight and breathable.

Typically, the separation between adjacent tubular structures within the array is less than 15 millimetres. Advantageously, separations below this upper limit can prevent objects from piercing the apparatus. Such objects may include raised objects on the surface with which the user makes contact during an impact, for example rocks. Preferably, the separation is less than 10 millimetres, and more preferably between 3 and 5 millimetres.

Typically, the maximum width of each of the tubular structures in the plane perpendicular to the axial direction of said tubular structure is between 4 and 50 millimetres, preferably between 8 and 25 millimetres, more preferably between 10 and 12 millimetres. Smaller tubular structures may help prevent objects piercing the apparatus, and larger tubular structures may help reduce the weight of the apparatus thereby increasing comfort for the user. This range of widths advantageously provides a balance of comfort and protection for the user.

Preferably, the maximum width of a plurality of the tubular structures in the plane perpendicular to the axial direction of said tubular structure at any one location along the axial direction varies along the axial direction by no more than 40%, preferably by no more than 30%, more preferably by no more than 20%, most preferably by no more than 10%. That is, the width of each tubular structure should be substantially the same at any location along the length of the tubular structure, e.g. it should not be cone shaped. This prevents the tubular structure from collapsing in on itself along the axial direction during an impact. As discussed above, there may be a small variation in the width of the tubular structures along their length, owing to the walls themselves being tapered in order to facilitate removal of the apparatus following a forming process such as injection moulding.

Typically, the interior region of a tubular structure occupies between 30% and 90%, preferably between 50% and 80%, of the maximum width of the tubular structure in the plane perpendicular to its axial direction. A larger interior region will advantageously reduce the weight of the apparatus, although the wall of the tubular structure cannot be too thin because this would increase the risk of the wall breaking, rather than compressing, during an impact.

Preferably, the position of the at least partial discontinuity around the respective axial direction is different for at least some adjacent tubular structures. For example, for a first tubular structure adjacent to a second tubular structure, the angular variation between a first at least partial discontinuity present in the first tubular structure and a second at least partial discontinuity present in the second tubular structure may be no less than 5 degrees. Were the partial discontinuities to align for adjacent tubular structures, this may cause underside collapse characteristics of the array and may create impact angles at which the array is likely to fail. By staggering the position of the partial discontinuities, this advantageously provides greater impact protection in realistic circumstances, where the surface may be uneven or the impacting object of irregular shape.

Preferably, the surface defined by the connected array of tubular structures is curved. Preferably, the surface is curved prior to use. This has an advantage that the apparatus can be curved to fit the intended body part such as a knee or shin. Optionally, the surface is substantially flat prior to use. This has an advantage that the apparatus may be easier to transport. The flexibility of the apparatus may allow the user to bend the apparatus to fit the relevant body part.

The apparatus may be formed from a thermoplastic or thermoset material such as polyurethane foam, PU, silicone or natural rubber. These materials are suitable for impact absorption. Typically, the apparatus is formed from a thermoplastic material. Preferably, the material is a thermoplastic elastomer, TPE, thermoplastic polyurethane, TPU, or a thermoplastic vulcanizate, TPV. These materials are particularly suitable for impact absorption. Furthermore these materials are more sustainable because they are easier to recycle than thermoset materials.

Preferably, the apparatus is formed from a material having a Shore A hardness of between 20 and 95 Shore A, preferably between 40 and 75 Shore A, more preferably between 50 and 70 Shore A. A material which is too hard will not compress sufficiently during an impact and may break. A material which is too soft may potentially compress too much, i.e. to the point of failure. The above ranges provide a balance to control compression and avoid failure.

The apparatus may be formed from a foamed or unfoamed material. Foamed materials are less dense and therefore beneficially reduce the weight of the apparatus. Unfoamed materials are easier to process and therefore beneficially simplify the manufacturing of the apparatus.

Preferably, the interior region of each tubular structure is empty. By "empty" we mean that the interior region is not filled with any solid or liquid material. This advantageously reduces the weight and increases the flexibility of the apparatus. Alternatively, the walls of the tubular structures may be made of a first material and the interior region of one or more tubular structures may contain a second material which is different from the first material. The second material may entirely fill or only partially fill the interior region. Preferably the second material is a less dense material in order to ensure the apparatus is lightweight.

Typically, each of a plurality of the tubular structures is open at one, preferably both ends along the axial direction. For tubular structures which are open at only one end, preferably the partial discontinuity is arranged at the open end. The closed end may be made from the same material as the walls of the tubular structures or a different material. Tubular structures that are open at both ends along the axial direction are beneficially breathable, flexible and lightweight. Preferably the tubular structures that are open at both ends are open all the way through the tubular structure, i.e. are hollow structures. Tubular structures that are open at only one end may advantageously protect the user from abrasion whilst being flexible.

Optionally, the apparatus may comprise a first portion and a second portion, wherein the first portion has a first connected array of tubular structures having first parameters and the second portion has a second connected array of tubular structures having second parameters different from the first parameters. This may allow different regions of the apparatus to be configured for different purposes. The different parameters may include any of the parameters of the tubular structures and array described above, and preferably include different size and/or shaped tubular structures and/or different forms of at least partial discontinuities, e.g. different size and/or shaped notches.

For example, the first portion may comprise tubular structures having smaller, triangular tubular structures having a flat-base notch and the second portion may comprise tubular structures having larger, hexagonal tubular structures having a pointed-base notch. Any combination of parameters may be selected based on technical or design requirements. Advantageously, areas of the protector requiring greater impact protection may be designed accordingly, whilst areas of the protector which do not require the highest level of impact protection may be made more lightweight and flexible. This reduces the weight of the apparatus as a whole, making it more comfortable for users whilst providing the necessary impact protection.

Another aspect of the invention provides a garment comprising an apparatus according to the description above. Advantageously the garment may be worn by a user. Typically the garment comprises a pocket into which the apparatus is inserted in use. This ensures that the apparatus can be easily inserted and held close to the user's body in use. The pocket material may provide additional protection against abrasion during an impact. Alternatively the garment may comprise attaching means such as straps, poppers, strings or zips. Such attaching means can be used to securely attach the apparatus to the user. As a further alternative, the apparatus may be an integral part of the garment.

Typically, the garment is a helmet, body armour, shoulder pad, elbow pad or a knee pad. The apparatus is designed to be suitable for any limb protector or back protector.

When the apparatus is designed for different parts of the body, different size tubular structures may be used to provide the required protection. For example, some areas of the body may require greater thickness provided by the apparatus, which in turn may require larger diameter tubular structures to provide the required deformation for impact absorption. Particularly for larger tubular structures, there may be a tendency for the structure to stretch or become weak. Accordingly, it may be preferable to provide that each of a plurality of the tubular structures (preferably each of the tubular structures) comprises one or more internal supporting elements extending across the tubular structure at an angle to the axial direction, preferably substantially perpendicular to the axial direction. Preferably, the one or more internal supporting elements extend between opposing interior sides of the tubular structures. In some embodiments, a plurality of internal supporting elements meet within the tubular structures, preferably at the centre of the tubular structure. These internal supporting elements are particularly useful for tubular structures having a largest width in a direction perpendicular to the axial direction of at least 12 millimetres, preferably at least 15 millimetres, more preferably at least 20 millimetres. Preferably these internal supporting elements are located at a base end of the tubular structures. The base end may be the side of the apparatus not intended to receive an impact, e.g. the side intended to be worn against the body and/or at which the tubular structures are connected by a connecting sheet or connecting members, and may be opposite a free end of the tubular structure, i.e. which has no internal supporting elements and also has no connecting sheet or connecting members.

A further aspect of the invention provides a method of manufacturing an apparatus for absorbing an impact. The method comprises the steps of: providing a connected array of tubular structures to define a surface for absorbing an impact, each tubular structure having a wall defining an interior region of the tubular structure extending substantially along an axial direction of said tubular structure; wherein the axial direction of each tubular structure extends substantially perpendicularly to the surface; and wherein the wall of each of a plurality of the tubular structures is at least partially discontinuous, such that said tubular structures preferentially deform in the region of the discontinuity during an impact.

The apparatus manufactured according to this aspect of the invention corresponds to the apparatus described above and so all of the preferred features described above may be provided in the apparatus manufactured according to this method. The at least partial discontinuities may be provided following the provision of the connected array of tubular structures. For example, the tubular structures may be provided and then notches may be cut into a plurality of the tubular structures. However, typically the tubular structures are formed with the at least partial discontinuities present. Advantageously this simplifies the manufacturing process. This method provides an apparatus which is flexible, lightweight and breathable for the reasons described above.

As noted above, the method comprises providing the connected array of tubular structures as defined. Typically, this comprises forming the connected array of tubular structures as defined. Preferably, providing the connected array of tubular structures comprises forming the connected array of tubular structures by injection moulding. This is advantageously a relatively cheap and fast technique. Typically, when the method is performed using injection moulding, the wall of one or more, preferably each, of the tubular structures is tapered in the same direction along the axial direction to allow easy removal of the apparatus following the manufacture. Alternatively, providing the connected array of tubular structures may comprise forming the connected array of tubular structures by 3D printing. This technique can be used to provide tubular structures that do not have a tapered wall. This advantageously results in a more lightweight apparatus.

BRIEF DESCRIPTION OF THE DRAWINGS

Embodiments of the invention will now be described with reference to the accompanying drawings in which.

DETAILED DESCRIPTION

Figure 1:
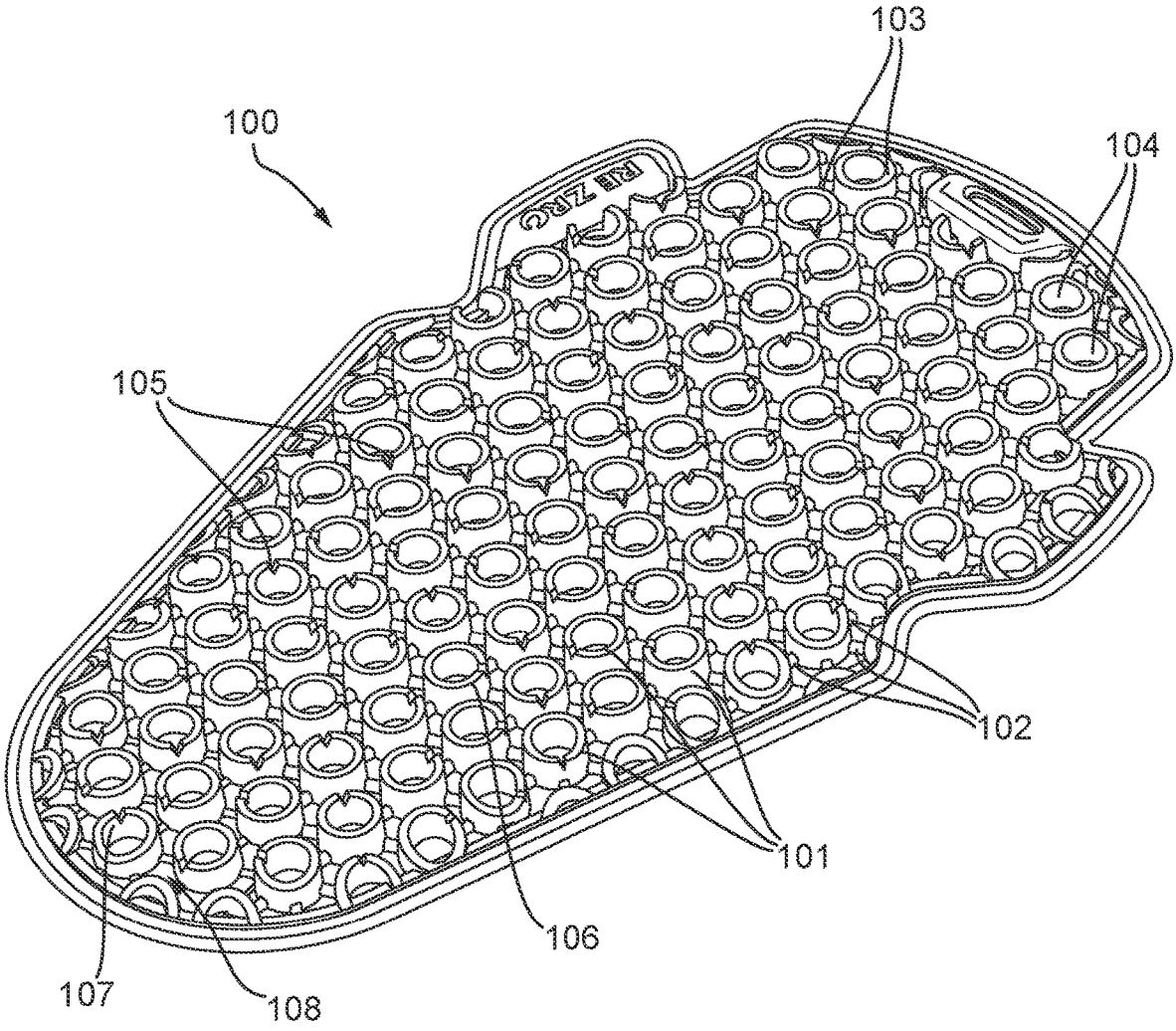
FIG. 1 is a perspective view of an apparatus.

FIG. 1 illustrates a perspective view of an apparatus 100 for absorbing an impact in accordance with the invention. The apparatus may form part of a garment such as a helmet, body armour, a shoulder pad, elbow pad or a knee pad. The apparatus may be strapped directly to a user to provide cushioning for an impact. Alternatively, the apparatus may be inserted into a pocket of a garment to provide additional protection against abrasion during an impact. The apparatus is suitable for absorbing an impact from a fall such as a motorcycle fall.

The apparatus 100 includes a plurality of tubular structures 101 that are connected by connecting members 102. The tubular structures 101 form a connected array which defines a surface for absorbing an impact (the top side of the apparatus shown in FIG. 1). In this example, the surface is substantially flat, however in alternative examples the surface is curved. Each tubular structure 101 has a wall 103 which defines an interior region 104. In this example the interior region 104 is hollow, however in an alternative example the interior region may be filled or partially filled with material different from the material of the wall. The wall 103 of a tubular structure 101 extends substantially along an axial direction of that tubular structure. The axial direction of each tubular structure 101 is substantially perpendicular to the surface defined by the connected array of tubular structures 101 at the location of that tubular structure 101. For an example in which the surface is curved, the axial direction of one tubular structure is typically not the same as the axial direction of another tubular structure due to the underlying curvature.

The wall 103 of each of a plurality of the tubular structures comprises a notch 105. In this embodiment, each of the tubular structures comprises a notch. Walls having a notch are partially discontinuous: a portion of the wall 103 entirely surrounds the interior region 104; and a portion of the wall 103 is discontinuous in that the notch 105 breaks the continuity of the wall 103. From the perspective shown in FIG. 1, the lower portion of the wall 103 is continuous and the upper portion of the wall 103 is discontinuous. The notch 105 helps control compression during an impact because each tubular structure 101 preferentially deforms in the region of the notch 105. In this example, the notches 105 are located in the same side of the tubular structures 101 along the axial direction, i.e. all of the notches 105 in the apparatus 100 are on the top side as shown in FIG. 1. In alternative examples, one or more notches may be on the opposite side.

The position of the notches 105 around the axial direction of their respective tubular structures 101 can be different for different tubular structures 101 in the array. The relative position of the notch 105 between adjacent tubular structures 101 may be the same or may be different. In this example, some tubular structures 101 that are adjacent have notches 105 positioned at the same angular location around each tubular structure 101 relative to the axial direction, and other tubular structures 101 that are adjacent have notches 105 positioned at different angular locations around each tubular structure 101 relative to the axial direction.

The walls 103 of each of the tubular structures 101 may vary in height across the apparatus 100. Further, the wall 103 of a single tubular structure 101 may vary in height across the single tubular structure 101. The height of the wall of a tubular structure 101 is measured along its axial direction. In the example illustrated in FIG. 1, the height of the walls 103 is substantially even across a central portion of the apparatus 100, and the height of the walls reduces in an edge portion of the apparatus 101. This increases user comfort because the edges of the apparatus can be made thinner.

The tubular structures 101 in FIG. 1 are all circular in their cross section in the plane perpendicular to their axial direction, although in alternative examples they may be any polygonal shape, typically a regular polygon, such as those illustrated in FIGS. 4A-4D and 5A-5D.

In this example, the apparatus 100 is made from a material having a hardness of 50 Shore A. The maximum height of the tubular structures 101 in the axial direction is 6.6 millimetres and the maximum width of each of the tubular structures 101 in the plane perpendicular to the axial direction is 10 millimetres. The maximum depth of each of the notches 105 is 35% of the maximum height of the tubular structures 101, and the maximum width of each of the notches 105 is 15% of the maximum width of each of the tubular structures 101, i.e. the maximum width of each of the notches 105 along the length of the wall in the plane perpendicular to the axial direction of the tubular structure is 15% of the length of the wall of the tubular structure in said plane. The separation between adjacent tubular structures within the connected array is between 3 millimetres and 5 millimetres.

The apparatus 100 comprises a portion 106 in which the tubular structures 101 are connected using connecting members 102 and each of the tubular structures is open at both ends. The maximum height of each of the tubular structures 101 along the axial direction is greater than the maximum height of each of its connecting members 102 along said direction. That is, the connecting members 102 are thinner than the tubular structures 101. Furthermore, the connecting members are disposed towards the lower end of each of the tubular structures. This provides additional flexibility and reduces the weight of the apparatus 100, and also ensures that the connecting members do not interfere with the absorption of an impact.

In addition to the portion 106 described above, the apparatus 100 also comprises a portion 107 in which there is a membrane 108, or backing sheet, supporting the tubular structures 101 and closing the tubular structure at the lower end. In this example, the second portion 107 comprises a membrane 108 in addition to connecting members 102. In alternative examples a portion of the apparatus may comprise only a membrane.

The apparatus 100 in FIG. 1 is made of unfoamed TPE (thermoplastic elastomer). In other examples the apparatus can be made of other thermoplastic materials and can be foamed or unfoamed. In further specific examples, the apparatus can be made of TPU (thermoplastic polyurethane) or TPV (thermoplastic vulcanizate).

The apparatus 100 is made by providing a connected array of tubular structures to define a surface, each tubular structure having a wall defining an interior region of the tubular structure extending substantially along an axial direction of said tubular structure. As described above, the axial direction of each tubular structure extends substantially perpendicularly to the surface; and the wall of each of a plurality of the tubular structures is at least partially discontinuous, such that said tubular structures preferentially deform in the region of the discontinuity during an impact. The apparatus is made using injection moulding or 3D printing.

The apparatus 100 according to the invention provides both flexibility for a user, allowing the user to move freely and comfortably whilst wearing the protective apparatus. Crucially, the apparatus 100 also provides rigidity to protect the user from blunt impact. The necessary rigidity is provided using a modified structure rather than additional thickness which makes the apparatus 100 more lightweight. In order to assess whether the apparatus 100 is suitable for protecting a user during an impact, the apparatus must pass the EN 1621-1 2012 standard for limb protectors or the EN 1621-2 2014 standard for back protectors.

Figure 2:
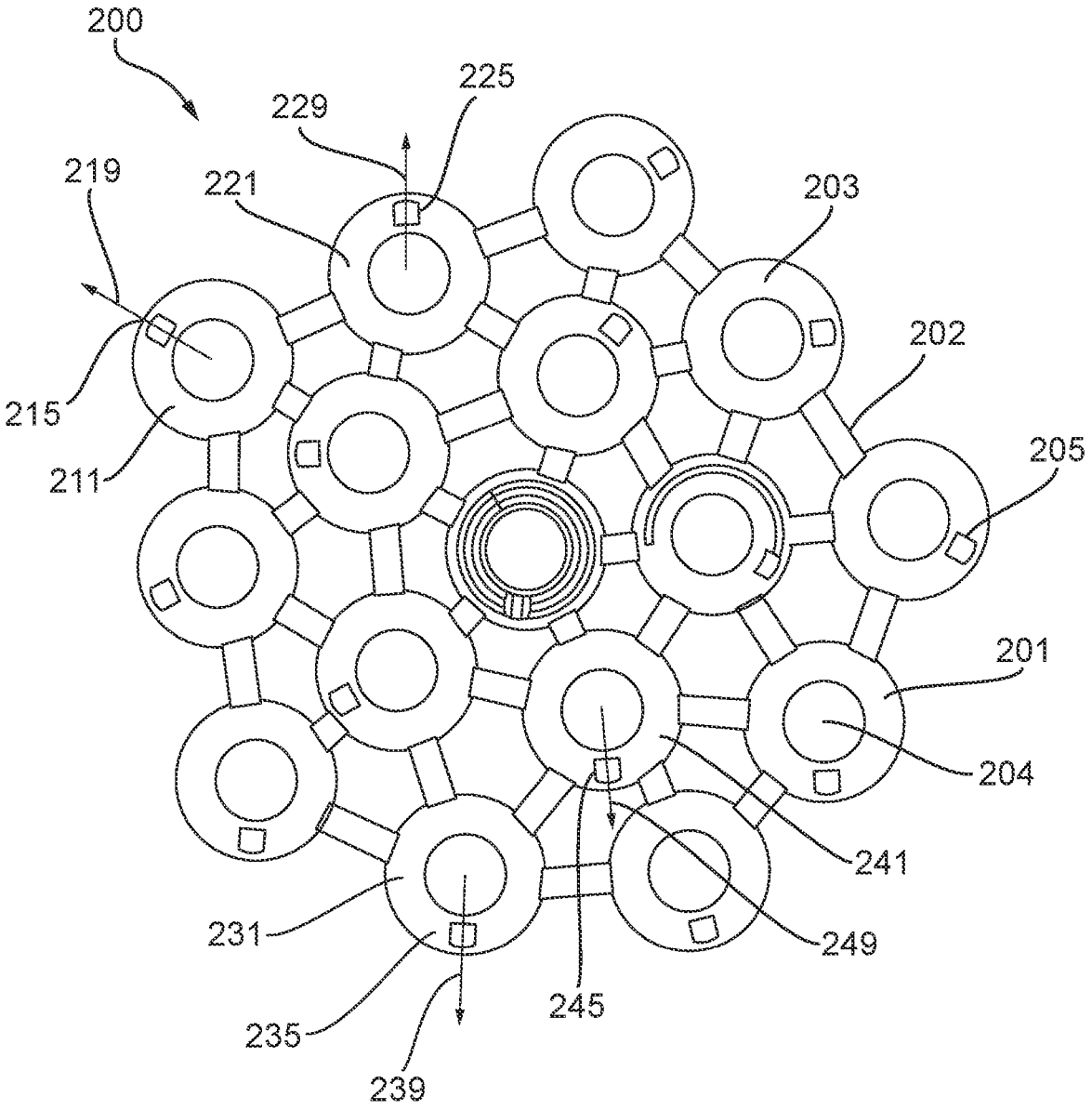
FIG. 2 is an enlarged plan view of a portion of an apparatus.

FIG. 2 shows an enlarged plan view of a region of an apparatus 200 for absorbing impact in accordance with the invention. The apparatus 200 includes a connected array of tubular structures 201 which defines a surface. Each tubular structure 201 is connected to one or more adjacent tubular structures 201 in the array using respective connecting members 202.

Each tubular structure 201 has a wall 203 which defines an interior region 204. The interior region 204 is empty. The wall 203 of a tubular structure 201 extends substantially along an axial direction of that tubular structure. The axial direction of each tubular structure 201 is substantially perpendicular to the surface defined by the connected array of tubular structures 201 at the location of that tubular structure 201. In FIG. 2, the axial direction of each tubular structure 201 extends substantially perpendicularly out of the plane of the page. Each of the tubular structures is open at both ends along the axial direction.

Each tubular structure 201 is tapered along its axial direction. Each of the tubular structures 201 is tapered along the respective axial direction. The walls 203 of the tubular structures are tapered in the same direction along the axial direction. Each tubular structure 201 has a first end and a second end between which the wall 203 of the tubular structure 201 extends. For each tubular structure 201, the first end is smaller than the second end due to the tapered wall. The plan view shown in FIG. 2 shows the first ends in front of the second ends of the tubular structures 201. The apparatus 200 is made using injection moulding and therefore the tapered shape of the tubular structures 201 facilitates removal of the apparatus 200 after manufacture.

Each tubular structure 201 in FIG. 2 has one notch 205, which is a partial discontinuity in one end of the tubular structure 201. Each notch is in the first end in this example. In alternative examples, a notch may be in one or both of the first and second ends of a plurality of tubular structures.

As clearly shown in FIG. 2, the position of the notches can vary between adjacent tubular structures 201. For example, a first notch 215 in a first tubular structure 211 is positioned in a first direction 219 relative to the axial direction of the first tubular structure 211. A second tubular structure 221 is adjacent to the first tubular structure 211 because the second tubular structure 221 is directly connected to the first tubular structure 211 using a connecting member 202. The second notch 225 in the second tubular structure 221 is positioned in a second direction 229 relative to the axial direction of the second tubular structure 221. The second direction 229 is different from the first direction 219. The second tubular structure 221 is similar to the first tubular structure 211, but appears to be rotated relative to the first tubular structure 211 such that the position of the first and second notches 215, 225 is different.

The relative position of notches between adjacent tubular structures need not always differ so significantly. Taking another pair of adjacent tubular structures in the apparatus 200 of FIG. 2 as an example, it can be seen that the position is substantially the same. A third notch 235 in a third tubular structure 231 is positioned in a third direction 239 relative to the axial direction of the third tubular structure 231. A fourth tubular structure 241 is adjacent to the third tubular structure 231 because the fourth tubular structure 241 is directly connected to the third tubular structure 231 using a connecting member 202. The fourth notch 245 in the fourth tubular structure 241 is positioned in a fourth direction 249 relative to the axial direction of the fourth tubular structure 241. The fourth direction 249 is substantially the same as the third direction 239.

In FIG. 2, the separation between tubular structures 201 is between 3 millimetres and 6 millimetres. This separation is defined by the length of the connecting members 202. The height of the wall of each of the tubular structures along the axial direction in this example is 7.5 millimetres.

Figure 3:
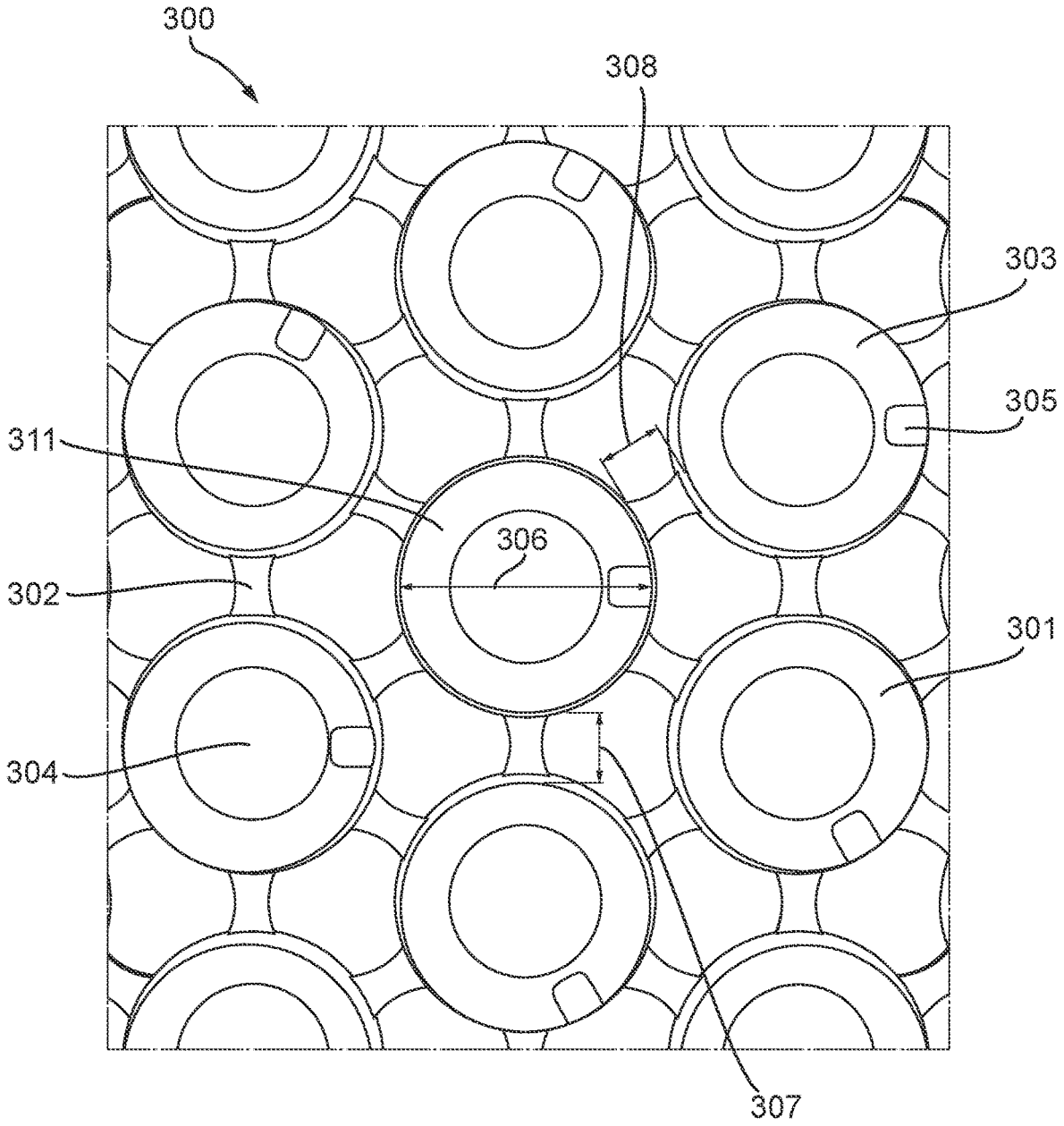
FIG. 3 is an enlarged plan view of a portion of an apparatus.

FIG. 3 illustrates a plan view of a region of an apparatus 300 for absorbing impact in accordance with the invention. The apparatus 300 includes a connected array of tubular structures 301 which defines a surface. Each tubular structure 301 is connected to one or more adjacent tubular structures 301 in the array using respective connecting members 302. The height of each of the tubular structures 301 along the axial direction is greater than the height of each its connecting members along the same direction. The tubular structures 301 have a circular cross-section and a first tubular structure 311 has six adjacent tubular structures 301. In this example, the first tubular structure 311 is connected to each of the adjacent tubular structures 301 using a connecting member 302.

In FIG. 3, each notch 305 only extends through a partial thickness of the wall 303 between the interior region 304 and the exterior of the respective tubular structure 301. In the illustrated example, the notch 305 does not extend fully through the wall towards the interior region 304.

The width 306 of a tubular structure 301 in the plane perpendicular to the axial direction is between 8 millimetres and 20 millimetres, preferably between 10 millimetres and 12 millimetres. In this example, the width 306 is 12 millimetres.

The separation 307, 308 between adjacent tubular structures 301 within the array is less than 15 millimetres. In this example, the separation 307, 308 is 4 millimetres. In this example, the separation 307, 308 is defined by the length of the respective connecting members. In alternative examples, such as the apparatus shown in FIG. 2, the separation between adjacent tubular structures varies across the apparatus.

In FIG. 3, the edges of the tubular structures 301 are not tapered. The apparatus 300 may be made using 3D printing.

FIGS. 4A-4D illustrate examples of tubular structures 411, 421, 431, 441. Tubular structures present an efficient way of producing a structure for a large surface coverage and reduction of weight. Each of the tubular structures 411, 421, 431, 441 has a wall 413, 423, 433, 443 defining an interior region 414, 424, 434, 444 of the tubular structure 411, 421, 431, 441. Each tubular structure 411, 421, 431, 441 has a respective axial direction 418, 428, 438, 448. The wall 413, 423, 433, 443 of each tubular structure 411, 421, 431, 441 extends substantially parallel to the respective axial direction 418, 428, 438, 448.

Figure 4A:
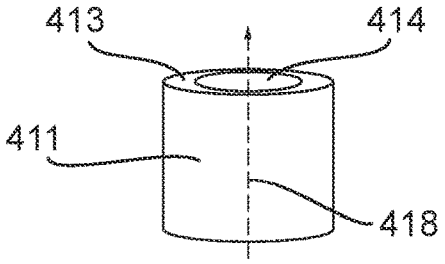
FIGS. 4A to 4D are illustrations of four different types of tubular structure.
Figure 4B:
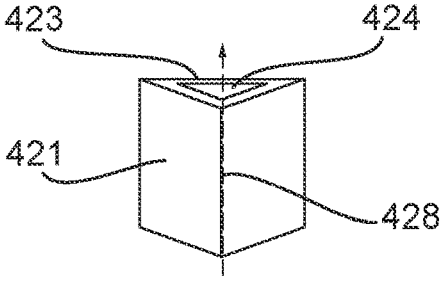
Figure 4C:
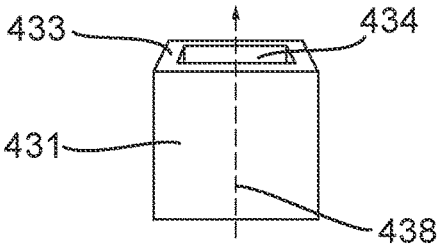
Figure 4D:
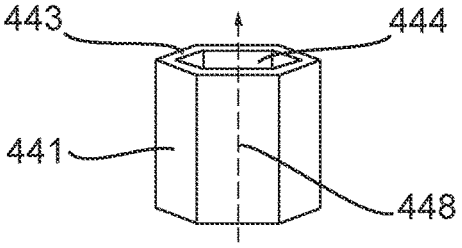

The cross-section of each of the tubular structures shown in FIGS. 4A-4D is a regular polygon. The cross-section is viewed in a plane perpendicular to the axial directions 418, 428, 438, 448. FIG. 4A illustrates a first tubular structure 411 which has a circular cross-section. FIG. 4B illustrates a second tubular structure 421 which has a triangular cross-section. FIG. 4C illustrates a third tubular structure 431 which has a square cross-section. FIG. 4D illustrates a fourth tubular structure 441 which has a hexagonal cross-section.

A standard tubular structure without an at least partial discontinuity such as those illustrated in FIGS. 4A-4D successfully reduce weight but may not perform adequately to protect a user during an impact. For example, for a hard material (Shore A 70-90), there is little compression on the tubular structure and some force is absorbed and dissipated but the majority of the force still passes through which leads to failure. Harder materials are more stable in higher temperatures whilst remaining flexible but in cold temperatures, harder materials can be very rigid and can cause a higher amount of damage during an impact. Harder, more rigid, materials are also less flexible and are not as comfortable for the user. Harder materials cannot be made too thin, because then there would be no compression and the impact would be spread instead of absorbed, similar to the outer part of a helmet without the pads.

For a soft material (Shore A 20-60), the compression of a standard tubular structure without an at least partial discontinuity is better for absorbing impact energy. However, the tubular structures cannot be made too thin because this would risk failure due to excessive compression. Furthermore, in higher temperatures the softer material can become too soft, which will mean that the tubular structure compresses too much during an impact, leading to failure.

Therefore, in order for the apparatus to function across a range of temperatures, from −20 C to 40 C, the apparatus of the invention provides at least partial discontinuities in a plurality of the tubular structures of the apparatus. This controls compression to achieve a thickness that balance flexibility, weight and impact performance.

The tubular structures 511, 521, 531, 541 shown in FIGS. 5A-5D are similar to those shown in FIGS. 4A-4D, and additionally include a notch 515, 525, 535, 545. Each of the tubular structures 511, 521, 531, 541 has a wall 513, 523, 533, 543 defining an interior region 514, 524, 534, 544 of the tubular structure 511, 521, 531, 541. Each tubular structure 511, 521, 531, 541 has a respective axial direction 518, 528, 538, 548. The wall 513, 523, 533, 543 of each tubular structure 511, 521, 531, 541 extends substantially parallel to the respective axial direction 518, 528, 538, 548. The wall 513, 523, 533, 543 of each of tubular structure 511, 521, 531, 541 is only partially discontinuous: a portion of the wall 513, 523, 533, 543 extends completely around the interior region 514, 524, 534, 544 (i.e. is continuous) and only a portion of the wall 513, 523, 533, 543 is discontinuous due to the presence of the notch 515, 525, 535, 545.

Figure 5A:
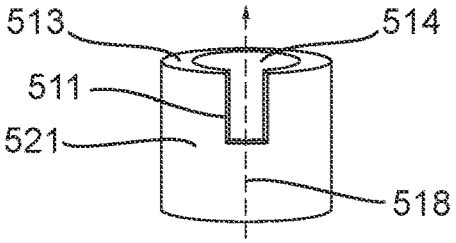
FIGS. 5A to 5D are illustrations of four different types of tubular structure with a notch.

The tubular structure 511 in FIG. 5A has a circular cross-section. The notch 515 in the tubular structure 511 is substantially rectangular in that the notch has parallel sides and a flat base. In other examples, the notch can be any shape such as those illustrated in FIGS. 6A-6C, 7A-7C and 8A-8C. The notch 515 can be positioned at any location in the wall 513 of the circular tubular structure. In this example, there is one notch 515, however more notches may be positioned elsewhere along the wall 513.

Figure 5B:
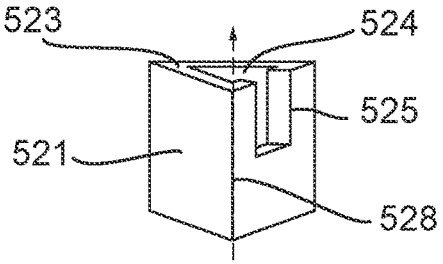

The tubular structure 521 in FIG. 5B has a triangular cross-section. In this example, the notch 525 in the tubular structure 521 is positioned substantially centrally along one of the edges of the triangle. In another example, the notch can be positioned off-centre along an edge of the triangle, or the notch can be positioned across two edges of the triangle, i.e. at a corner. The notch 525 in the tubular structure 521 is substantially square. In this example, there is one notch 525, however more notches may be positioned elsewhere along the wall 523.

Figure 5C:
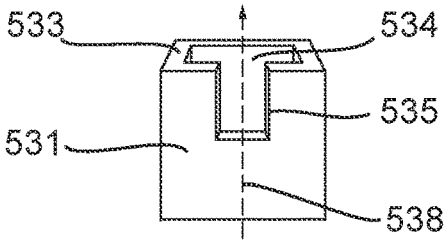

The tubular structure 531 in FIG. 5C has a square cross-section. In this example, the notch 535 in the tubular structure 531 is positioned substantially centrally along one of the edges of the square. In another example, the notch can be positioned off-centre along an edge of the square, or the notch can be positioned across two edges of the square, i.e. at a corner. The notch 535 in the tubular structure 531 is substantially square. In this example, there is one notch 535, however more notches may be positioned elsewhere along the wall 533.

Figure 5D:
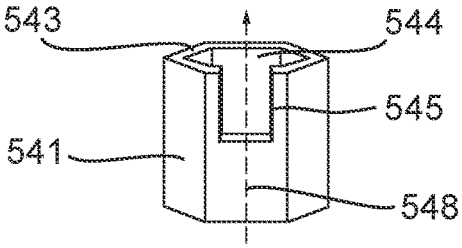

The tubular structure 541 in FIG. 5D has a hexagonal cross-section. In this example, the notch 545 in the tubular structure 541 is positioned substantially centrally along one of the edges of the hexagon. In another example, the notch can be positioned off-centre along an edge of the hexagon, or the notch can be positioned across two edges of the hexagon, i.e. at a corner. The notch 545 in the tubular structure 541 is substantially square. In this example, there is one notch 545, however more notches may be positioned elsewhere along the wall 543.

Figure 6A:
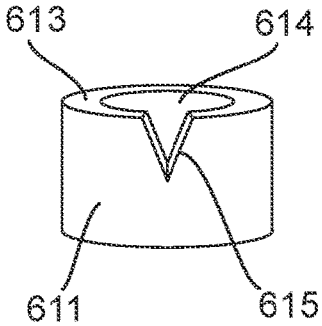
FIGS. 6A to 6C are illustrations of a tubular structure with a notch in perspective, side and cross-sectional views respectively.
Figure 6B:
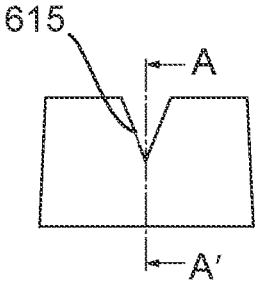
Figure 6C:
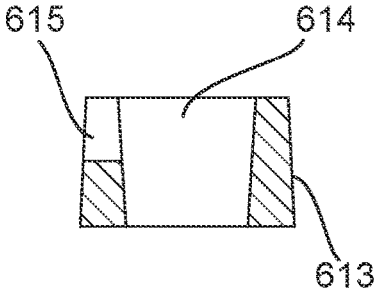

FIGS. 6A-6C illustrate a tubular structure 611 from three different perspectives. The base of the notch 615 of the tubular structure 611 is pointed. FIG. 6A shows the wall 613 of the tubular structure 611 defining the interior region 614. The wall 613 has a notch 615 that is substantially triangular, i.e. the notch has a pointed base. The widest part of the notch 615 is at the top of the wall 613. In this example, the tubular structure 611 has a circular cross-section, however the cross-section can be any polygon such as the shapes illustrated in FIGS. 5A-5D.

FIG. 6B illustrates a side-view of the tubular structure 611 illustrating the notch 615 having a pointed base. The illustrated notch 615 is symmetrical, although this is not required.

FIG. 6C illustrates a cross-section of the tubular structure 611 along the dashed line A-A' shown in FIG. 6B. As shown in cross-section, the notch 615 extends through the full thickness of the wall 613 between the interior region 614 of the tubular structure 611 and the exterior of the tubular structure 611. The maximum depth of the notch 615 along the axial direction is approximately 50% of the height of the wall 613 of the tubular structure 611 in this example. The wall 613 is tapered along the axial direction to be thinner at the top.

Figure 7A:
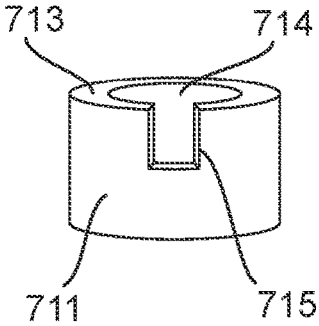
FIGS. 7A to 7C are illustrations of a tubular structure with a notch in perspective, side and cross-sectional views respectively.
Figure 7B:
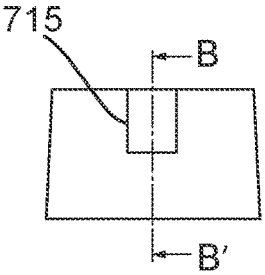
Figure 7C:
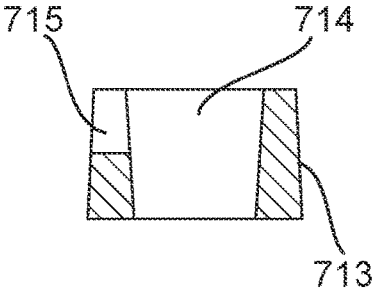

FIGS. 7A-7C illustrate a tubular structure 711 from three different perspectives. The base of the notch 715 of the tubular structure 711 is flat. FIG. 7A shows the wall 713 of the tubular structure 711 defining the interior region 714. The wall 713 has a notch 715 that is substantially square, i.e. the notch has substantially parallel sides and a flat base substantially perpendicular to the sides of the notch. The notch 715 is therefore substantially the same width for the entire depth of the notch 715. In this example, the tubular structure 711 has a circular cross-section, however the cross-section can be any polygon such as the shapes illustrated in FIGS. 5A-5D.

FIG. 7B illustrates a side-view of the tubular structure 711 illustrating the notch 715 having a flat base. FIG. 7C illustrates a cross-section of the tubular structure 711 along the dashed line B-B' shown in FIG. 7B. As shown in cross-section, the notch 715 extends through the full thickness of the wall 713 between the interior region 714 of the tubular structure 711 and the exterior of the tubular structure 711. The depth of the notch 715 along the axial direction is approximately 50% of the height of the wall 713 of the tubular structure 711 in this example. The wall 713 is tapered along the axial direction.

Figure 8A:
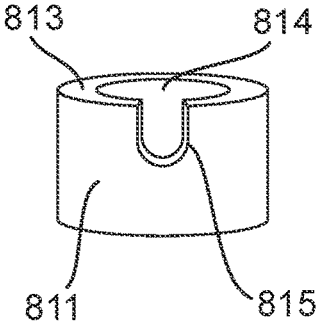
FIGS. 8A to 8C are illustrations of a tubular structure with a notch in perspective, side and cross-sectional views respectively.
Figure 8B:
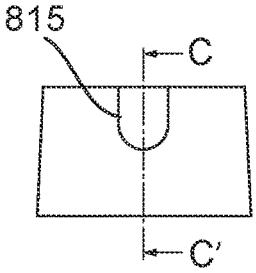
Figure 8C:
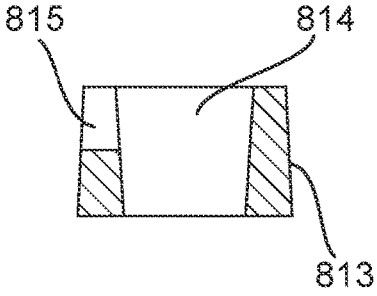

FIGS. 8A-8C illustrate a tubular structure 811 from three different perspectives. The base of the notch 815 of the tubular structure 811 is curved. FIG. 8A shows the wall 813 of the tubular structure 811 defining the interior region 814. The wall 813 has a notch 815 that is substantially semi-circular, i.e. the notch has a curved base. Although the base of the notch 815 is curved, the upper region of the notch 815 has parallel sides in this example. In other examples, such as examples in which the notch is less deep, the upper region of the notch may be curved rather than straight. The widest part of the notch 815 in this example and the other examples mentioned is at the top of the wall 813. In this example, the tubular structure 811 has a circular cross-section, however the cross-section can be any polygon such as the shapes illustrated in FIGS. 5A-5D.

FIG. 8B illustrates a side-view of the tubular structure 811 illustrating the notch 815 having a curved base. FIG. 8C illustrates a cross-section of the tubular structure 811 along the dashed line C-C' shown in FIG. 8B. As shown in cross-section, the notch 815 extends through the full thickness of the wall 813 between the interior region 814 of the tubular structure 811 and the exterior of the tubular structure 811. The maximum depth of the notch 815 along the axial direction is approximately 50% of the height of the wall 813 of the tubular structure 811 in this example. The wall 813 is tapered along the axial direction.

Figure 9:
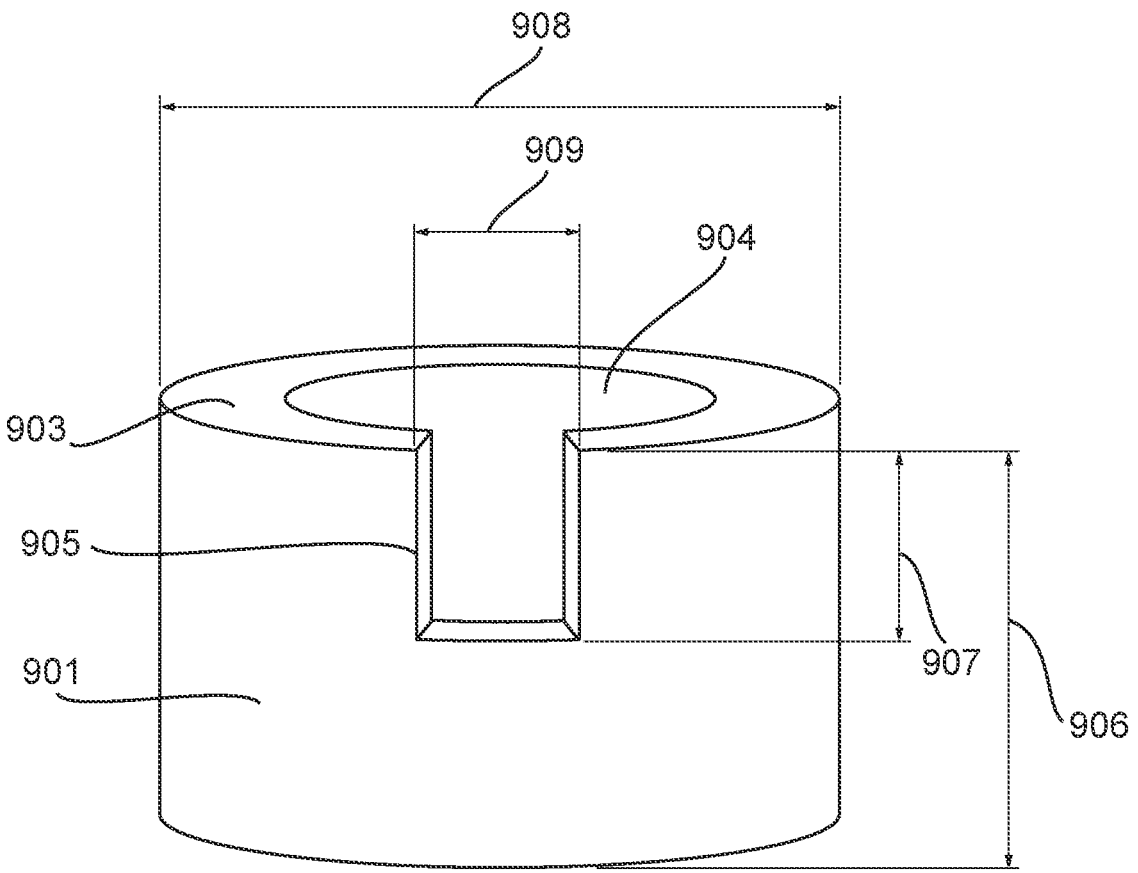
FIG. 9 is an illustration of a tubular structure with a notch in perspective view.

FIG. 9 illustrates a circular cross-section tubular structure 901 with a flat-based notch 905 in order to illustrate some relative dimensions of different aspects of the tubular structure. The wall 903 of the tubular structure 901 defines an interior region 904. The maximum depth 907 of the notch 905 along the axial direction is between 5% and 75% of the height 906 of the wall 903 of the tubular structure 901.

The maximum width 909 of the notch 905 along the length of the wall in the plane perpendicular to the axial direction is between 10% and 25% of the length 908 of the wall of the tubular structure 901 in said plane. For a tubular structure having a circular cross-section, the width 908 of the tubular structure in the plane perpendicular to the axial direction is equivalent to the outer diameter of the tubular structure 901. For a tubular structure having a non-circular cross-section, the width 908 of the tubular structure is the maximum width, for example diagonally across a square cross-section or from one corner to the opposite corner across a hexagonal cross-section.

Figure 10A:
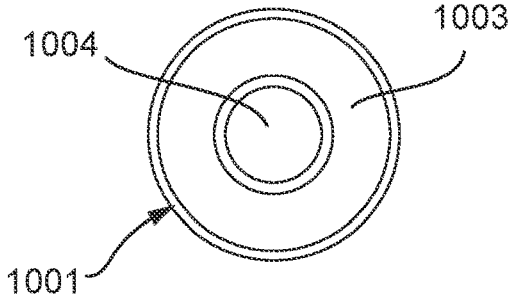
FIGS. 10A to 10D are a plan and a side view of a tubular structure without a discontinuity and side views of the tubular structures during two different types of impact respectively.
Figure 10B:
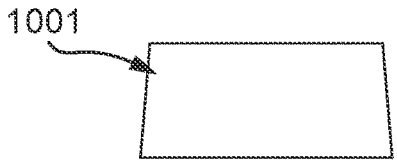

FIGS. 10A-10D illustrate a tubular structure 1001 without a notch. FIG. 10A is a plan view of the tubular structure 1001 showing a wall 1003 surrounding an interior region 1004. FIG. 10B is a side view of the tubular structure 1001 shown in FIG. 10A. The tubular structure 1001 is tapered along its axial direction.

Figure 10C:
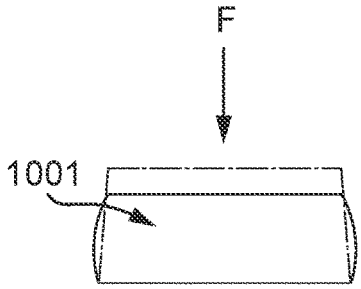
Figure 10D:
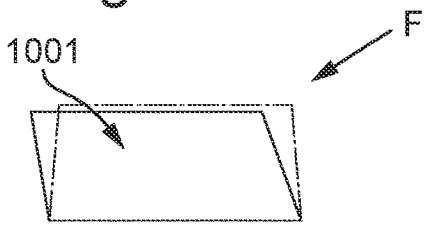

FIGS. 10C and 10D schematically illustrate the deformation of the tubular structure 1001 during an impact. The dashed lines indicate the shape of the tubular structure 1001 prior to the impact, F, and the solid lines indicate the shape in response to the impact, F. FIG. 10C illustrates the deformation in response to an impact applied from the top of the tubular structure 1001. FIG. 10D illustrates the deformation in response to an impact applied from a side angle relative to the tubular structure 1001.

Apparatus having a tubular structure according to FIGS. 10A-10D was tested in accordance with the EN 1621-1 2012 standard for limb protectors. In order to pass Level 1 of the standard, the average transmitted force must be less than or equal to 35 kN. For a height along the axial direction of 7.5 millimetres, the average transmitted force in ambient temperatures was 31.9 kN, and the average transmitted force at −20 C was 32.4 kN.

Figure 11A:
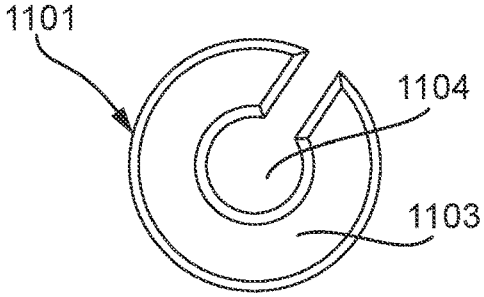
FIGS. 11A to 11D are a plan and a side view of a tubular structure with a full discontinuity and side views of the tubular structures during two different types of impact respectively.
Figure 11B:
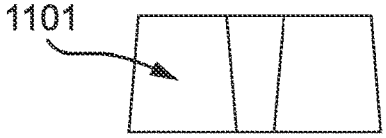

FIGS. 11A-11D illustrate a tubular structure 1101 with a discontinuous wall 1103. FIG. 11A is a plan view of the tubular structure 1101 showing a wall 1103 defining, but not surrounding, an interior region 1104. The wall 1103 is discontinuous. FIG. 11B is a side view of the tubular structure 1101 shown in FIG. 11A. The tubular structure 1101 is tapered along its axial direction.

Figure 11C:
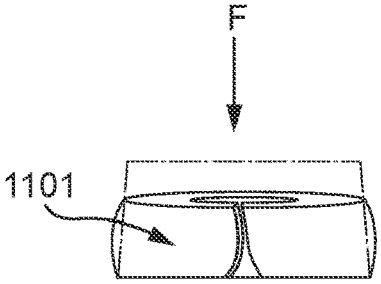
Figure 11D:
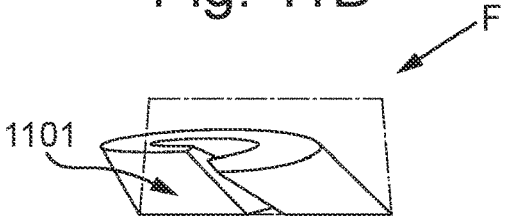

FIGS. 11C and 11D schematically illustrate the deformation of the tubular structure 1101 during an impact. The dashed lines indicate the shape of the tubular structure 1101 prior to the impact, F, and the solid lines indicate the shape in response to the impact, F. FIG. 11C illustrates the deformation in response to an impact applied from the top of the tubular structure 1101. FIG. 11D illustrates the deformation in response to an impact applied from a side angle relative to the tubular structure 1101.

Relative to the tubular structure 1001 illustrated in FIGS. 10A-10D, the tubular structure 1101 illustrated in FIGS. 11A-11D is more flexible when using the same material, because the shape deforms and collapses when impact is applied from the top or the side. The tubular structure 1101 preferentially deforms in the region of the discontinuity during an impact.

Apparatus having a tubular structure according to FIGS. 11A-11D was tested in accordance with the EN 1621-1 2012 standard for limb protectors. In order to pass Level 1 of the standard, the average transmitted force must be less than or equal to 35 kN. For a height along the axial direction of 7.5 millimetres, the average transmitted force in ambient temperatures was 28 kN, and the average transmitted force at −20 C was 29 kN. These values are lower than those measured during the test of the tubular structure according to FIGS. 10A-10D. Furthermore, during a high impact test, the tubular structure according to FIGS. 11A-11D collapsed and returned to its original form.

Figure 12A:
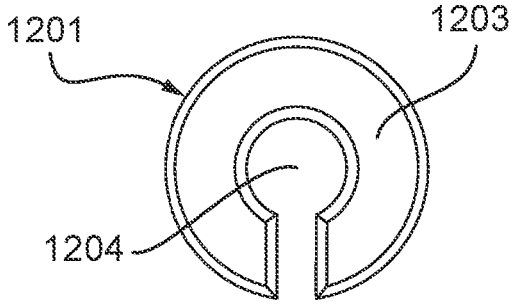
FIGS. 12A to 12F are top and side views of a tubular structure with a full discontinuity and four perspective views of the tubular structures during different types of impact respectively.
Figure 12B:
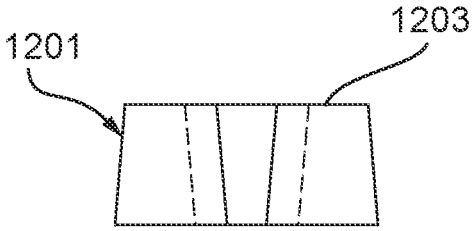

FIGS. 12A-12F illustrate a tubular structure 1201 with a discontinuous wall 1203. FIG. 12A is a plan view of the tubular structure 1201 showing a wall 1203 defining, but not surrounding, an interior region 1204. The wall 1203 is discontinuous. FIG. 12B is a side view of the tubular structure 1201 shown in FIG. 12A. The tubular structure 1201 is tapered along its axial direction.

Figure 12C:
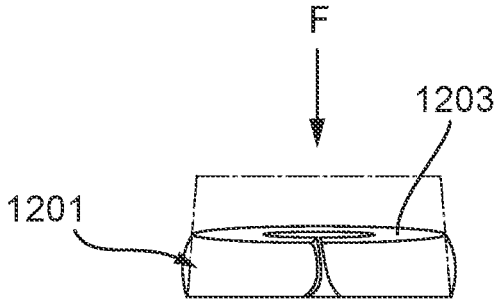
Figure 12D:
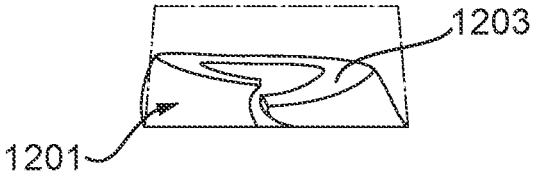
Figure 12E:
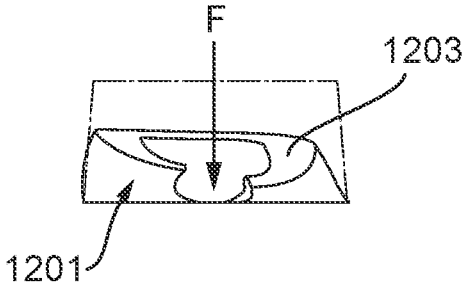

FIGS. 12C-12E schematically illustrate the deformation of the tubular structure 1201 during an impact from the top of the tubular structure. The dashed lines indicate the shape of the tubular structure 1201 prior to the impact, F, and the solid lines indicate the shape in response to the impact, F. FIG. 12C illustrates the deformation in response to a relatively small impact. It can be seen that the tubular structure preferentially deforms in the region of the gap in the wall, i.e. the discontinuity.

FIG. 12D illustrates the deformation in response to a larger impact than that of FIG. 12C. Under a larger impact, the tubular structure 1201 will compress further.

FIG. 12E illustrates the deformation in response to a high energy impact force, i.e. a larger impact than that of FIG. 12D. Under such an impact, the compression of the tubular structure 1201 may lead to failure. The failure point will depend on the height of the wall 1203 and the material used to form the tubular structure 1201.

Figure 12F:
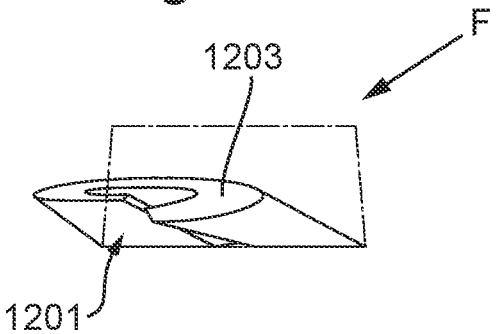

FIG. 12F schematically illustrates the deformation of the tubular structure 1201 during an impact from an angle. The dashed lines indicate the shape of the tubular structure 1201 prior to the impact, F, and the solid lines indicate the shape in response to the impact, F. FIG. 12F shows that the tubular structure preferentially deforms in the region of the discontinuity during an impact.

Figure 13A:
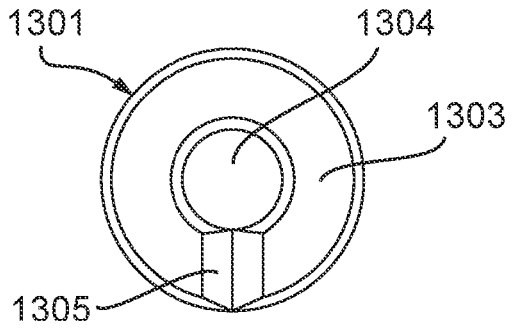
FIG. 13A to 13F are top and side views of a tubular structure with a notch and four perspective views of the tubular structures during different types of impact respectively.
Figure 13B:
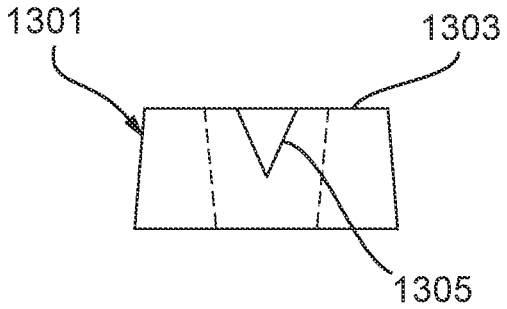

FIGS. 13A-13F illustrate a tubular structure 1301 with a discontinuous wall 1303. FIG. 13A is a plan view of the tubular structure 1301 showing a wall 1303 defining an interior region 1304. The wall 1303 has a notch 1305 which makes the wall 1303 partially discontinuous. In this example, the notch 1305 has a pointed base. FIG. 13B is a side view of the tubular structure 1301 shown in FIG. 13A. The tubular structure 1301 is tapered along its axial direction.

Figure 13C:
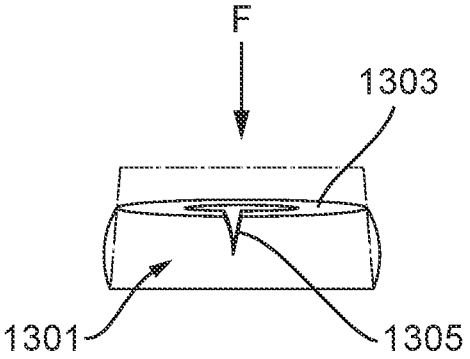
Figure 13D:
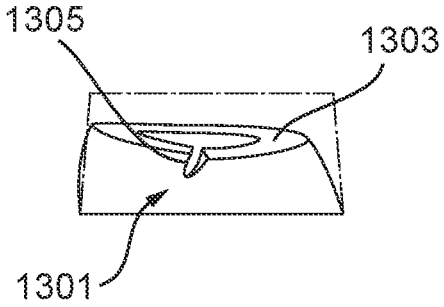
Figure 13E:
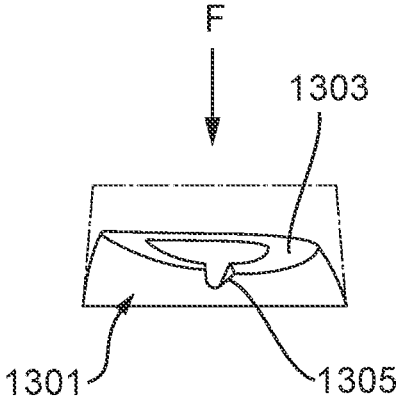

FIGS. 13C-13E schematically illustrate the deformation of the tubular structure 1301 during an impact from the top of the tubular structure. The dashed lines indicate the shape of the tubular structure 1301 prior to the impact, F, and the solid lines indicate the shape in response to the impact, F. FIG. 13C illustrates the deformation in response to a relatively small impact. It can be seen that the tubular structure preferentially deforms in the region of the notch in the wall, i.e. the partial discontinuity, during an impact.

FIG. 13D illustrates the deformation in response to a larger impact than that of FIG. 13C. Under a larger impact, the tubular structure 1301 will compress further. The amount of compression increases less in response to an increased impact for a tubular structure 1301 having a notch, such as that illustrated in FIGS. 13A-13F, than for a tubular structure 1201 having a discontinuity extending the full height of the wall, such as that illustrated in FIGS. 12A-12F.

FIG. 13E illustrates the deformation in response to a high energy impact force, i.e. a larger impact than that of FIG. 13D. Under such an impact, the compression of the tubular structure 1301 increases but does not reach a failure point. Subject to the same impact force, a tubular structure with a notch has more controlled compression than a tubular structure with a gap in the wall. This is because the partial discontinuity helps control the compression and deformation.

Figure 13F:
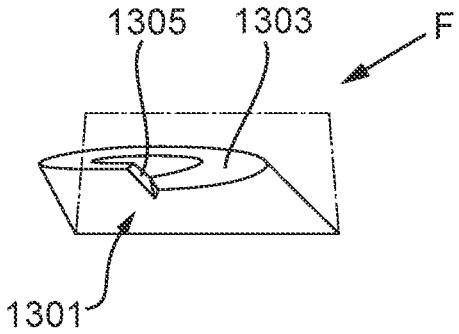

FIG. 13F schematically illustrates the deformation of the tubular structure 1301 during an impact from an angle. The dashed lines indicate the shape of the tubular structure 1301 prior to the impact, F, and the solid lines indicate the shape in response to the impact, F. FIG. 13F shows that the tubular structure preferentially deforms in the region of the partial discontinuity. The deformation and compression of the tubular structure 1301 with a notch (as in FIGS. 13A-13F) is more controlled during application of the same impact than the deformation and compression of the tubular structure 1201 with a gap in the wall (as in FIGS. 12A-12F).

Apparatus having a tubular structure according to FIGS. 13A-13F was tested in accordance with the EN 1621-1 2012 standard for limb protectors. In order to pass Level 1 of the standard, the average transmitted force must be less than or equal to 35 kN. For a height along the axial direction of 7.5 millimetres, the average transmitted force in ambient temperatures was 21.42 kN, and the average transmitted force at −20 C was 15.12 kN, and the average transmitted force at 40 C was 26.34 kN. The peak transmitted force was 28.39 kN in ambient temperatures, 16.75 kN at −20 C, and 33.01 kN at 40 C. The apparatus passed the EN 1621-1 level 1 standard at all temperatures, and passed the EN 1621-1 level 2 standard at low temperature (−20 C). These values are lower than those measured during the test of the tubular structure according to FIGS. 10A-10D and FIGS. 11A-11D. Performance is dramatically improved relative to the tubular structure without an at least partial discontinuity and relative to the tubular structure with a full discontinuity. The partial discontinuity provided by the notch controls the compression of the tubular structure. The deformation of the tubular structures was enough to dissipate and absorb the impact without penetrating through the apparatus.

As will be appreciated, an apparatus for absorbing an impact in a controlled manner is disclosed. Tubular structures having an at least partial discontinuity are used to control the compression and deformation during an impact. The tubular structures having an at least partial discontinuity absorb impact better than a planar sheet of protective material, and better than tubular structures without any form of discontinuity. Therefore the apparatus comprising a plurality of tubular structures having an at least partial discontinuity can be made thinner than conventional apparatus for absorbing an impact. This provides a comfortable, flexible, lightweight and breathable apparatus for a user whilst ensuring the user is suitably protected during an impact.

Figure 14:
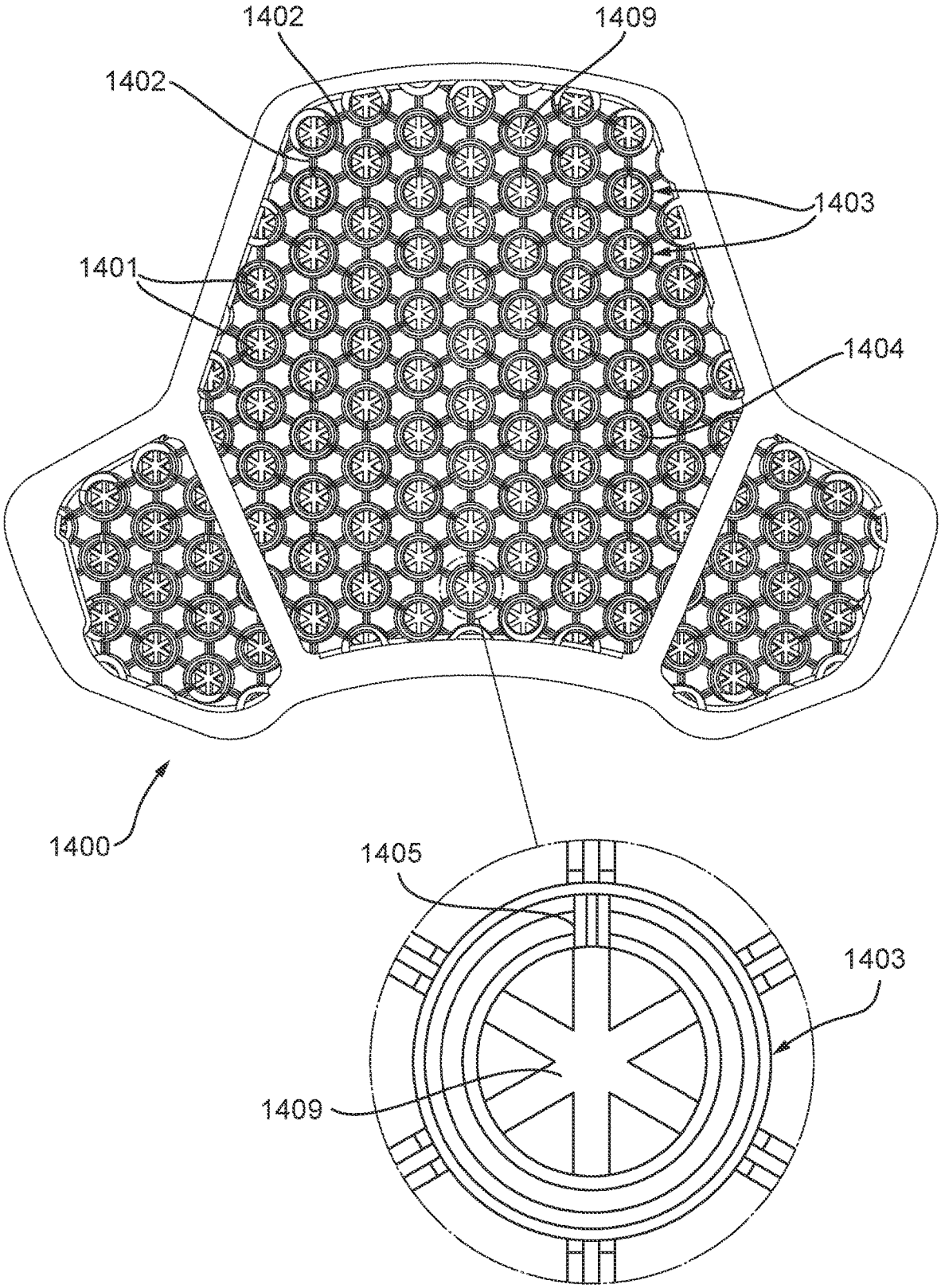
FIG. 14 is a top view of an apparatus showing an enlarged detail.

FIG. 14 shows another apparatus. The apparatus here is intended to be worn as a chest protector, and so may be larger than the apparatus shown and described with respect to FIG. 1.

The apparatus 1400 includes a plurality of tubular structures 1401 that are connected by connecting members 1402 forming a connected array which defines a surface for absorbing an impact. Each tubular structure 101 has a wall 1403 which defines an interior region 1404. In this example the interior region 1404 is mostly hollow, but does comprise a plurality of internal supporting elements 1409, which will be described in more detail below. The wall 1403 of a tubular structure 1401 extends substantially along an axial direction of that tubular structure. The axial direction of each tubular structure 1401 is substantially perpendicular to the surface defined by the connected array of tubular structures 1401 at the location of that tubular structure 1401.

The wall 1403 of each of a plurality of the tubular structures comprises a notch 1405. In this embodiment, each of the tubular structures comprises a notch. Walls having a notch are partially discontinuous: a portion of the wall 1403 entirely surrounds the interior region 1404; and a portion of the wall 1403 is discontinuous in that the notch 1405 breaks the continuity of the wall 1403 at one end of the tubular structure. The wall 1403 of a base end of each tubular structure is continuous and the wall of the free upper end of each tubular structure is discontinuous. The notch 1405 helps control compression during an impact because each tubular structure 1401 preferentially deforms in the region of the notch 1405. In this example, the notches 1405 are located in the same side of the tubular structures 1401 along the axial direction.

The position of the notches 1405 around the axial direction of their respective tubular structures 1401 can be different for different tubular structures 1401 in the array. In this example, some tubular structures 1401 that are adjacent have notches 1405 positioned at the same angular location around each tubular structure 1401 relative to the axial direction, and other tubular structures 1401 that are adjacent have notches 1405 positioned at different angular locations around each tubular structure 1401 relative to the axial direction.

In this embodiment, the diameter of the tubular structures 1401 is relatively large at around 22 millimetres. To prevent these large tubular structures from stretching or becoming weak, each tubular structure includes a plurality of interior supporting elements 1409. In this embodiment, the interior supporting elements 1409 are provided by six arms extending from an interior face of the tubular structure to a centre point of the tubular structure in a manner resembling the spokes of a wheel. These interior supporting elements 1409 have a height significantly smaller than the height of the tubular structures along their length. For example, the height of the tubular structures may be 10 millimetres while the height of the interior supporting elements 1409 may be only 2 millimetres. These interior supporting elements 1409 are located at the base end of each tubular structure, i.e. the same end as the connecting elements 1402 on the exterior of the tubular structures. Thus, the base end of each tubular structure is held in place by the connecting elements 1402 that connect to adjacent tubular structures and by the interior supporting elements 1409 that extend across within the tubular structure. Meanwhile, the upper end of each tubular structure, i.e. having the notches, is free to move during an impact as it deforms and absorbs the forces of the impact.

The invention claimed is:

1. Apparatus for absorbing an impact comprising:

a connected array of tubular structures defining a surface for absorbing an impact, each tubular structure having a wall defining an interior region of the tubular structure extending substantially along an axial direction of said tubular structure;

wherein the axial direction of each tubular structure extends substantially perpendicularly to the surface;

wherein the wall of each of a plurality of the tubular structures is at least partially discontinuous, such that said tubular structures preferentially deform in the region of the discontinuity during an impact;

wherein the plurality of tubular structures are connected by a connecting sheet or array of connecting members such that each tubular structure has at least one free end, spaced from the connecting sheet or array of connecting members along the axial direction; and wherein each at least partial discontinuity in the wall of a plurality of the tubular structures is provided in a free end of the respective tubular structure.

2. The apparatus according to claim 1, wherein the wall of each of a plurality of the tubular structures is partially discontinuous, such that at least a portion of the wall extends completely around the interior region.

3. The apparatus according to claim 2, wherein the wall of each of said plurality of the tubular structures is continuous at one end of each tubular structure along the axial direction, preferably the same end, such that the wall at said end extends completely around the interior region.

4. The apparatus according to claim 1, wherein the wall of each of the plurality of the tubular structures comprises a notch such that the wall is partially discontinuous, wherein a base of the notch is pointed, curved, or flat.

5. The apparatus according to claim 4, wherein the notch extends through the full thickness of the wall between the interior region of said tubular structure and an exterior of said tubular structure.

6. The apparatus according to claim 1, wherein each tubular structure has only one free end, preferably on a same side of the connecting sheet or array of connecting members in the axial direction.

7. The apparatus according to claim 1, wherein each of a plurality of the tubular structures is connected to one or more adjacent tubular structures in the array using respective connecting members.

8. The apparatus according to claim 7, wherein the height of each of the said tubular structures along the axial direction is greater than the height of each of its connecting members along said direction.

9. The apparatus according to claim 1, wherein each of a plurality of the tubular structures comprises one or more internal supporting elements extending across said tubular structures at an angle to the axial direction, preferably substantially perpendicular to the axial direction.

10. The apparatus according to claim 9, wherein the one or more internal supporting elements extend between opposing interior sides of the tubular structures.

11. The apparatus according to claim 9 wherein a plurality of internal supporting elements meet within the tubular structures, preferably at the centre of the tubular structures.

12. The apparatus according to claim 1, wherein the position of the one or more at least partial discontinuities around the respective axial direction is different for at least some adjacent tubular structures.

13. The apparatus according to claim 1, wherein the apparatus is formed from a thermoplastic material, wherein the thermoplastic material is a thermoplastic elastomer, TPE, thermoplastic polyurethane, TPU, or a thermoplastic vulcanizate, TPV.

14. The apparatus according to claim 1, wherein the apparatus is formed from a foamed or unfoamed material.

15. The apparatus according to claim 1, wherein the interior region of each tubular structure is empty.

16. The apparatus according to claim 1, wherein the apparatus comprises a first portion and a second portion, wherein the first portion has a first connected array of tubular structures having first parameters and the second portion has a second connected array of tubular structures having second parameters different from the first parameters, and the different parameters preferably include different size and/or shaped tubular structures and/or different forms of at least partial discontinuities.

17. A garment comprising the apparatus according to claim 1, wherein the garment is a helmet, body armour, shoulder pad, elbow pad or a knee pad.

18. Apparatus for absorbing an impact comprising:

a connected array of tubular structures defining a surface for absorbing an impact, each tubular structure having a wall defining an interior region of the tubular structure extending substantially along an axial direction of said tubular structure;

wherein the axial direction of each tubular structure extends substantially perpendicularly to the surface;

wherein the wall of each of a plurality of the tubular structures is at least partially discontinuous, such that said tubular structures preferentially deform in the region of the discontinuity during an impact;

wherein the plurality of tubular structures are connected by a connecting sheet or array of connecting members such that each tubular structure has at least one free end, spaced from the connecting sheet or array of connecting members along the axial direction, wherein said free end of each tubular structure of the plurality of tubular structures is an open free end; and wherein each at least partial discontinuity in the wall of a plurality of the tubular structures extends along the axial direction from the open free end of the respective tubular structure towards the connecting sheet or array of connecting members and does not reach the connecting sheet or array of connecting members.

19. The apparatus according to claim 18, wherein each tubular structure of the plurality of tubular structures is open at both ends along the axial direction.

20. Apparatus for absorbing an impact comprising:

a connected array of tubular structures defining a surface for absorbing an impact, each tubular structure having a wall defining an interior region of the tubular structure extending substantially along an axial direction of said tubular structure;

wherein the axial direction of each tubular structure extends substantially perpendicularly to the surface;

wherein the wall of each of a plurality of the tubular structures is at least partially discontinuous defining a notch in the wall of each of the plurality of the tubular structures, such that said tubular structures preferentially deform in the region of the discontinuity during an impact, wherein each of the plurality of the tubular structures has only one notch;

wherein each tubular structure of the plurality of tubular structures are open at both ends along the axial direction;

wherein the plurality of tubular structures are connected by a connecting sheet or array of connecting members such that each tubular structure has at least one free end, spaced from the connecting sheet or array of connecting members along the axial direction, wherein the free end of each tubular structure of the plurality of tubular structures is an open free end;

wherein the position of the notch around the respective axial direction is different for at least some adjacent tubular structures of the plurality of tubular structures; and wherein each notch in the wall of a plurality of the tubular structures extends along the axial direction from the open free end of the respective tubular structure towards the connecting sheet or array of connecting members and does not reach the connecting sheet or array of connecting members.

* * * * *